United States Patent [19]

Naokawa et al.

[11] Patent Number: 4,528,496

[45] Date of Patent: Jul. 9, 1985

[54] CURRENT SUPPLY FOR USE IN LOW VOLTAGE IC DEVICES

[75] Inventors: Toyojiro Naokawa, Tsurugashimamachi; Matsuro Koterasawa, Tokyo, both of Japan

[73] Assignee: National Semiconductor Corporation, Santa Clara, Calif.

[21] Appl. No.: 507,309

[22] Filed: Jun. 23, 1983

[51] Int. Cl.[3] ..... G05F 3/20

[52] U.S. Cl. ..... 323/315; 323/316; 330/288

[58] Field of Search ..... 323/273, 312, 315, 316; 330/284, 288

[56] References Cited

U.S. PATENT DOCUMENTS 4,329,639 5/1982 Davis ..... 323/315
4,350,904 9/1982 Cordell ..... 323/315
4,380,740 4/1983 Kaplan ..... 330/288
4,435,678 3/1984 Joseph et al. ..... 323/315

FOREIGN PATENT DOCUMENTS 58-80715 5/1983 Japan ..... 323/315

*Primary Examiner*—Peter S. Wong
*Assistant Examiner*—D. L. Rebsch
*Attorney, Agent, or Firm*—Gail W. Woodward; Paul J. Winters; Michael J. Pollock

[57] ABSTRACT

A current mirror provides an output current, for use in an IC, that is a multiple of a reference current input. A high gain negative feedback loop is coupled between the current mirror reference input and the output device. This forces the reference input to operate as a diode and stabilizes the circuit operation so that the output current accurately reflects the reference current independently of the $\beta$ of the devices.

8 Claims, 4 Drawing Figures

CURRENT SUPPLY FOR USE IN LOW VOLTAGE IC DEVICES

BACKGROUND OF THE INVENTION

The invention relates to current mirror supplies in which a reference current is employed to develop an output current for operating monolithic integrated circuits. In battery operated devices it is important that such current supplies operate at low voltage. Davis U.S. Pat. No. 4,329,639 shows one such circuit. A resistor is used to develop a voltage that represents a difference in the emitter to base voltage of transistors in a current mirror. This voltage is included in the negative feedback loop of a stabilizing circuit.

SUMMARY OF THE INVENTION

It is an object of the invention to provide a low supply voltage current source that produces an output current that is closely related to a reference current.

It is a further object of the invention to develop an output current that is a function of a reference current in a circuit that employs a current mirror in a high gain negative feedback current configuration that operates at a very low power supply voltage.

These and other objects are achieved in a circuit that is configured as follows. A constant reference current device is coupled in series with the collector of a current source transistor. The difference is fed to the base of a control transistor which is coupled to drive a current mirror turnaround that in turn develops the input to a current mirror that drives the base of the current source transistor. This configuration creates a high gain negative feedback current amplifier loop in which the current in the current source is forced to substantially equal the reference current. The current mirror associated with the current source transistor is also coupled to an output transistor or transistors that in combination produce a multiple of the reference current. The accuracy of such a circuit approaches that of the well-known super diode current mirror. However, while the super diode circuit requires a supply voltage of at least 1.3 volts at 300° K, the present circuit will operate well below one volt.

DESCRIPTION OF THE PRIOR ART

Figure 1:
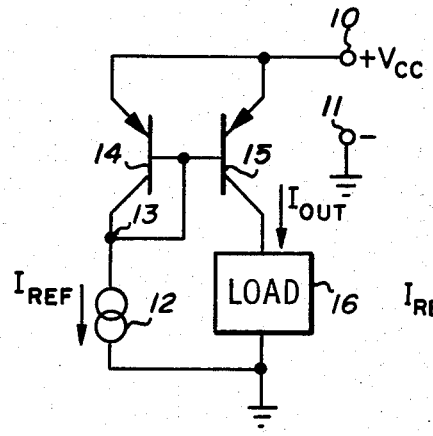
Fig 1 (PRIOR ART)
FIG. 1 is a schematic diagram of the standard prior art current mirror.

FIG. 1 illustrates the well known standard current source circuit. The circuit operates from a $V_{CC}$ power supply connected + to terminal 10 and − to ground terminal 11. This convention will be used in all of the circuits to be described in the following text. A constant current device 12 pulls $I_{REF}$ out of terminal 13. Therefore, $I_{REF}$ flows to diode connected transistor 14. This causes $I_{OUT}$ to flow in transistor 15 and load 16. Ordinarily $I_{OUT}$ exceeds $I_{REF}$ by some gain factor N so that $I_{OUT}=N\ I_{REF}$. This is typically accomplished by making transistor 15 into a plurality of individual devices the sum of which equals $I_{OUT}$. Thus one current, $I_{REF}$, is reflected as a plurality of controlled outputs. As long as the transistor $\beta$ is high the above formula is accurate. A more exact relationship is:

$$\frac{I_{OUT}}{I_{REF}} = \frac{N}{1 + \frac{N+1}{\beta}}$$

where $\beta$ is the base to collector current gain of the transistors and N is the current mirror gain. It can be seen that for very low $\beta$ transistors, for example about $\beta=10$, and $N=10$, the ratio $I_{OUT}$ to $I_{REF}$ approaches 5. In such a case the current mirror reflects only half of what is expected.

Figure 2:
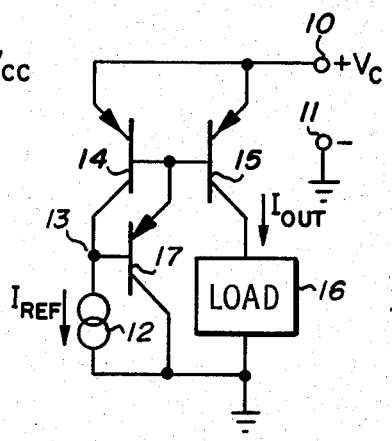
Fig 2 (PRIOR ART)
FIG. 2 is a schematic diagram of a prior art super diode current mirror.

FIG. 2 shows a super diode current mirror that acts to overcome the loss of accuracy for low $\beta$ transistors. Transistor 17 couples the collector of transistor 14' to its base so that it acts as if it were a diode. However, the collector to base connection has a current gain equal to the $\beta$ of transistor 17.

$$\frac{I_{OUT}}{I_{REF}} = \frac{N}{1 + \frac{N+1}{\beta(\beta+1)}}$$

While for low $\beta$ transistors where the circuit of FIG. 1 produces an $I_{OUT}$ of 5 the circuit of FIG. 2 produces an $I_{OUT}$ of slightly over 9. Thus, the circuit of FIG. 2 largely overcomes the low $\beta$ transistor problem.

Figure 3:
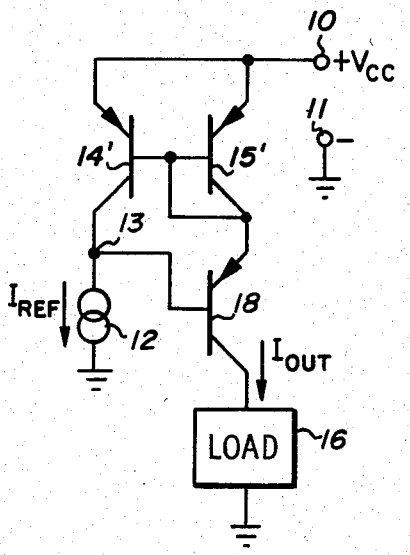
Fig 3 (PRIOR ART)
FIG. 3 is a schematic diagram of a prior art Wilson current mirror.

FIG. 3 illustrates the so-called Wilson current mirror. Here transistor 15' is diode connected and coupled to the emitter of output transistor 18. The base of transistor 18 is returned to the collector of transistor 14'. The formula for this circuit is:

$$\frac{I_{OUT}}{I_{REF}} = \frac{N + \frac{N+1}{\beta}}{1 + \frac{N+1}{\beta} + \frac{N+1}{\beta_2}}$$

Where $N=1$ the Wilson circuit is highly accurate even for low $\beta$ transistors. However, where $N=10$ low $\beta$ transistors will reduce the accuracy to a little better than that of the FIG. 1 circuit.

One problem associated with the circuits of both FIGS. 2 and 3 is that node 13 is $2V_{BE}$ below $C_{CC}$. This means that in order for device 12 to be functional it must be greater than a $V_{SAT}$ or the collector to emitter saturation voltage of a transistor. This in turn means that both of these circuits must have a $V_{CC}$ that exceeds $2V_{BE}+V_{SAT}$. At 300° K. this is about 1.3 to 1.4 volts. This rules out circuits that are designed to operate from a one cell battery.

The circuit disclosed by Davis in U.S. Pat. No. 4,329,639 operates at low voltage but it employs a voltage node in its negative feedback loop that acts to introduce instability when high B transistors are employed. Since IC designs should accept a broad spread of device parameters this is regarded as a brawback.

DESCRIPTION OF THE INVENTION

Figure 4:
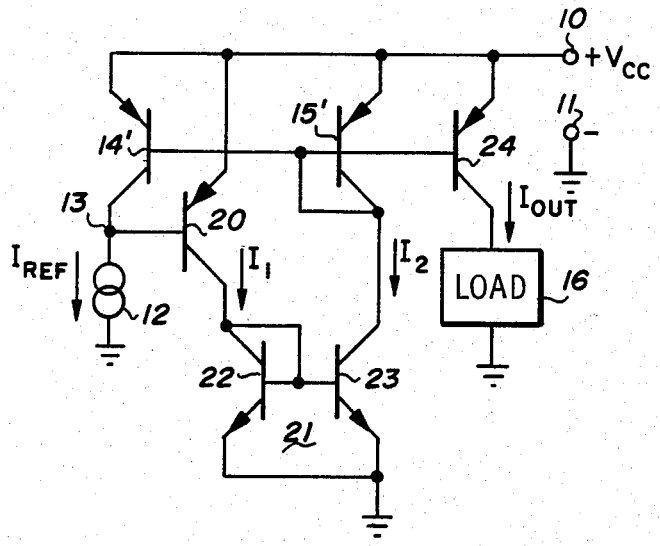
FIG. 4 is a schematic diagram of the current mirror of the invention.

FIG. 4 is a schematic diagram of the circuit of the invention. Constant current device 12 pulls $I_{REF}$ out of terminal 13. The circuit is stable when the current flowing in transistor 14' is below $I_{REF}$ by the base current of transistor 20. This increment is very small and depends upon the $\beta$ of transistor 20. The collector current of transistor 20 ($I_1$) flows into current mirror 21 which is composed of diode connected input transistor 22 and output transistor 23. Thus, $I_1$ is reflected as $I_2$ which flows in diode connected transistor 15'. Thus, the collector of transistor 23 drives the base of transistor 14' so that current mirror 21 completes a high current gain negative fedback loop around node 13. This will act to stabilize the circuit operating point as describd above. If $I_1=I_2$ the feedback loop has a current gain equal to the $\beta$ of transistor 20. This forces transistor 14' to act as if it were diode connected, as was the case in the circuit of FIG. 2. Thus, transistor 14' forms a current mirror with transistor 24, with the current gain determined by emitter areas. Clearly, if desired, mirror 21 can also be made to have current gain by making transistor 23 larger than transistor 22. For this case the loop gain is the $\beta$ of transistor 20 multiplied by the gain of mirror 21. Transistor 24 which has its base commonly connected to the bases of transistors 14' and 15' acts as the output transistor to drive load 16. Transistor 24 will be ratioed at N times transistor 14' or be composed of multiple transistors having an equivalent total size. The formula for this circuit is:

$$\frac{I_{OUT}}{I_{REF}} = \frac{N}{1 + \frac{\beta + 2 + N}{A \cdot \beta^2}}$$

Where A is the current gain of mirror 21 and it is assumed that the $\beta$ of the NPN transistors is much greater than 2N.

This formula shows that even where very low $\beta$ transistors are involved, an A of only 2 or 3 will bring the circuit accuracy up to that of the super diode.

It can be seen that node 13 is only one $V_{BE}$ below $V_{CC}$ so that the circuit can operate down to a supply voltage of $V_{BE}+V_{SAT}$. At 300° C. this is about 0.8 to 0.9 volt which is suitable for a one cell battery supply.

While the above-described circuit employs diode connected transistor 15' as the load element for transistor 23, such a load element can be eliminated as far as circuit operation is concerned. However, since the presence of transistor 15' makes transistor 23 a unity gain device, eliminating 15' can make the circuit unstable because of excessive current gain. With transistor 15' in the circuit as shown, the circuit is stable for all transistor $\beta$ values.

The invention has been described and its relationship to the prior art detailed. When a person skilled in the art reads the foregoing description, alternatives and equivalents, within the spirit and intent of the invention, will become apparent. Accordingly, it is intended that the scope of the invention be limited only by the following claims.

We claim:

1. A low voltage current supply for providing an output current that is a multiple, N, of a reference currrent, said supply comprising:

output transistor means for conducting said output current in response to base drive;

a first current mirror composed of said output transitor means and a diode operated input transistor coupled to drive the base of said output transistor means, said diode operated transistor being ratioed at 1/N times the area of said output transistor means;

a constant reference current input means coupled to conduct the collected current of said diode operated transistor;

a common emitter transistor amplifier having a base coupled to said collector of said diode operated transistor, and a collector; and a second current mirror having a diode connected input transistor coupled to conduct the collector current of said common emitter transistor amplifier and a base driven output transistor coupled to drive the diode operated input transistor of said first current mirror.

2. The supply of claim 1 wherein a diode connected transistor is coupled to conduct the collector current of said output transistor of said second current mirror, whereby said second current mirror has a current gain determined entirely by the emitter areas of its input and output transistors.

3. The supply of claim 1 wherein the transistors in said second current mirror are complementary to those in said first current mirror.

4. The supply of claim 3 wherein said second current mirror incorporates ratioed transistors that produce current gain between said input and output transistors.

5. A low voltage current mirror circuit comprising:

first and second supply rails connectable to a source of operating power;

a first transistor of one conductivity type having its emitter coupled to said first rail, a collector, and a base;

a constant reference current device coupled between said collector of said first transistor and said second rail;

a second transistor of said one conductivity type having an emitter coupled to said first rail, a base coupled to said collector of said first transistor and a collector;

a third transistor of a conductivity type opposite to that of said first transistor having a base and collector connected together to said collector of said second transistor and an emitter coupled to said second rail;

a fourth transistor of said opposite conductivity type having an emitter coupled to said second rail, a base coupled to said base of said third transistor, and a collector coupled to said base of said first transistor; and a fifth transistor of said one conductivity type having an emitter coupled to said first rail, a base coupled to said base of said first transistor and a collector coupled to provide an output current.

6. The circuit of claim 5 further comprising a sixth transistor of said one conductivity type having its collector and base coupled to said base of said first transistor and an emitter coupled to said first rail.

7. The circuit of claim 5 wherein said fifth transistor is ratioed to have an area that is greater than the area of said first transistor.

8. The circuit of claim 5 wherein said one transistor conductivity type is PNP, said first rail is positive with respect to said second rail, and said circuit sources said output current.

* * * * *